United States Patent [19]

Morse

[11] 4,146,229

[45] Mar. 27, 1979

[54] CARD HOLDER AND VIEWER CONSTRUCTION

[76] Inventor: Danny W. Morse, 1204 W. Newberg Rd., Pinconning, Bay County, Mich. 48650

[21] Appl. No.: 830,454

[22] Filed: Sep. 6, 1977

[51] Int. Cl.[2] ..... A63F 1/10

[52] U.S. Cl. ..... 273/150

[58] Field of Search ..... 273/150, 148 A; 272/8 M

[56] References Cited

U.S. PATENT DOCUMENTS

| | | | |
|---|---|---|---|
| 1,590,463 | 6/1926 | Wood | 272/8 M |
| 1,919,922 | 7/1933 | Baker et al. | 273/237 X |
| 3,779,554 | 12/1973 | Brix | 273/260 |

*Primary Examiner*—Anton O. Oechsle

*Attorney, Agent, or Firm*—Frease & Bishop

[57] ABSTRACT

A card holder and viewer specifically for use by handicapped people or others who are unable to hold a hand of playing cards during play of the game. A generally rectangularly-shaped box is formed by end walls, top and bottom walls, a back wall and a front wall which is inclined outwardly frontwardly with respect to the back wall. The end, back, front and bottom walls are formed of opaque plastic with the top wall being formed of transparent plastic. A viewing opening is formed between the front edge of the top wall and top edge of the front wall. A mirror is mounted within the box beneath the top wall and at a predetermined angle so that a plurality of playing cards, which are placed face down on the transparent top wall, can be viewed by an individual looking into the opening. The playing card images are reflected by the mirror through the viewing opening. The opaque walls prevent other players from seeing the cards placed on the top wall.

10 Claims, 3 Drawing Figures

CARD HOLDER AND VIEWER CONSTRUCTION

BACKGROUND OF THE INVENTION

1. Field of the Invention

The invention relates to a device for use by handicapped people for playing cards. More particularly, the invention relates to a card holder and viewer on which the playing cards are placed face down for viewing only by an individual looking through a viewing opening in the holder, and which prevents other players from viewing the cards regardless of their location at the table or surrounding area.

2. Description of the Prior Art

Many handicapped people desire to play cards with friends, but due to their particular physical handicap it may be difficult for them to hold a plurality of cards in their hand while adding and subtracting to their cards during play of the cards. Besides the difficulties encountered by the person in manipulating the cards, quite often adjacent players can easily view the person's cards, even though unintentional, which affects the play of the game.

One type of known card holder construction consists of an elongated bar having a longitudinal slot formed therein in which the cards are inserted and are maintained in a vertical upright position. This holder device has the serious disadvantage of enabling adjacent players to inadvertently see the cards. U.S. Pat. No. 2,211,480 discloses another type of viewing apparatus which is used by invalids or handicapped people who must remain in a lying position. Such an apparatus is considerably more elaborate than desired by most people who merely wish an inexpensive device that rests upon a card table in front of them.

No card holder and viewer construction of which I am aware enables an individual to place a plurality of playing cards face down on the holder, eliminating manual holding of the cards, and which enables the player to easily view the cards without the danger of adjacent players seeing the faces of the cards no matter how close they are seated.

SUMMARY OF THE INVENTION

Objectives of the invention include providing a card holder and viewer construction formed of inexpensive plastic material and a usual flat mirror member, which components are assembled into a box-like configuration to enable a card player to place a plurality of cards face down on the top of the box and to view the cards through an opening in the box by the reflection of the card images from the mirror which is mounted at an angle within the box; providing such a construction which prevents adjacent card players from accidentally or intentionally seeing the cards of the person using the holder, and which permits the user to manipulate only a single card at one time, or if necessary, enables another person to draw and discard cards onto and off of the top of the viewer for a seriously handicapped individual without this second person seeing the playing face of that card or others placed on the top; providing such a construction which is adapted to be placed on the top of a card table in front of the person using the same, which person assumes a usual seated position at the table, and in which the construction occupies relatively little space on the table and is extremely lightweight and easily transported and stored when not in use; providing such a construction which requires no external artificial light source for its use and operation, which is void of moving parts which are subject to breakage and repair, and which solves existing problems, satisfies needs and obtains new results in the art.

These objectives and advantages are obtained by the card holder and viewer construction of the invention, the general nature of which may be stated as including housing means having end walls, top and bottom walls, and front and rear walls forming a viewing chamber therebetween, with the end walls and front and rear walls being opaque; at least a portion of the top wall being transparent and forming a card receiving surface; opening means formed adjacent the front and top walls; and mirror means mounted within the viewing chamber and positioned at a predetermined angle, whereby the image of playing cards placed upon the transparent top wall portion will be reflected by the mirror means through the opening means for observation by an individual looking through said opening means.

BRIEF DESCRIPTION OF THE DRAWING

A preferred embodiment of the invention — illustrative of the best mode in which applicant has contemplated applying the principle — is set forth in the following description and shown in the accompanying drawing, and is particularly and distinctly pointed out and set forth in the appended claims.

Similar numerals refer to similar parts throughout the drawing.

DESCRIPTION OF THE PREFERRED EMBODIMENT

Figure 1:
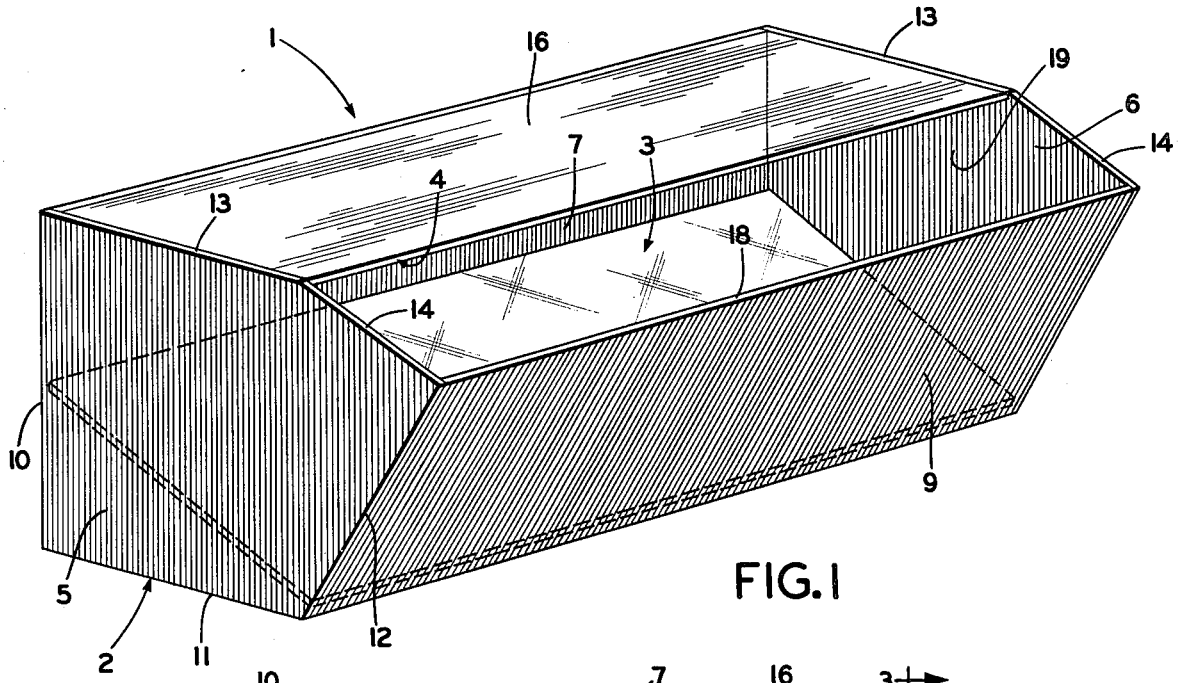
FIG. 1 is a perspective view of the improved card holder and viewer construction.

The improved card holder and viewer construction is indicated generally at 1, and includes as its main components a box-like housing 2, a reflective mirror 3 and a viewing window opening 4.

Housing 2 is formed by parallel end walls 5 and 6 which are connected by a vertical back wall 7 and a horizontal bottom wall 8, both of which are perpendicular to end walls 5 and 6. A front wall 9 extends upwardly outwardly with respect to the front end of bottom wall 8 and preferably forms an included obtuse angle of approximately 120° with bottom wall 8.

Back wall 7, bottom wall 8 and front wall 9 are generally flat rectangular-shaped rigid panels. End walls 5 and 6 also are flat rigid panels, each having a pentagonal configuration defined by a back edge 10, a bottom edge 11, an inclined front edge 12, a horizontal top edge portion 13, and a downwardly sloped front edge portion 14. End walls 5 and 6, back wall 7, and front wall 9 preferably are formed of opaque plastic material, although they can be formed of metal, wood, or other generally rigid-type material without affecting the concept of the invention.

A horizontal top wall 16 extends longitudinally between top edge portions 13 of end walls 5 and 6, and the top edge of back wall 7 and is perpendicular with the planes of end walls 5 and 6 and back wall 7. Top wall 16 is formed of clear transparent plastic material, such as plexiglass. Viewing window opening 4 is defined by the front edge 17 of top wall 16, inclined top edge portions 14 of end walls 5 and 6, and the top edge 18 of front wall 9. The walls of housing 2 form a hollow interior or viewing chamber 19 within housing 2, with window opening 4 providing a visual access opening into chamber 19.

Figure 3:
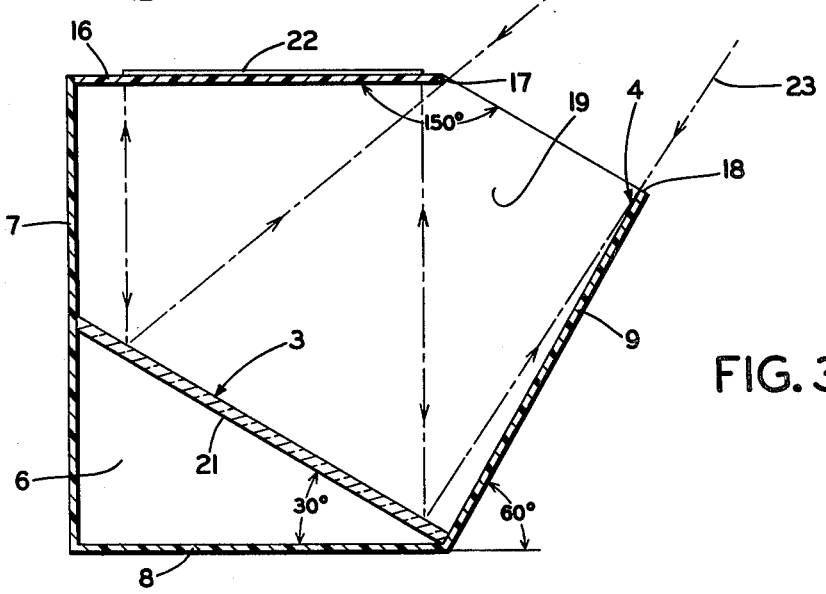
FIG. 3 is a vertical sectional view taken on line 3—3, FIG. 2.

Mirror 3 preferably is a usual flat rectangular-shaped mirror member having a reflective rear surface 21. Mirror 3 has a longitudinal length generally equal to the longitudinal length of back wall 7, bottom wall 8 and front wall 9. Mirror 3 has a width greater than the width of bottom wall 8 so as to be mounted at an angle within chamber 19 of housing 2, as shown in FIG. 3. Mirror 3 preferably forms an included angle of approximately 30° with respect to horizontal bottom wall 8, and is mounted generally vertically beneath transparent top wall 16 and within the line of sight or field of view of an individual looking through window opening 4. The plane of the surface of top wall 16 in a longitudinal direction is parallel to the plane of the surface of mirror 3 in a longitudinal direction, as can be seen in FIG. 3.

A card player desiring to use improved holder and viewer construction 1, places it in front of him or her on a card table (not shown) with bottom wall 8 resting on top of the card table playing surface. A plurality of playing cards 22 are placed face down on and along transparent top wall 16, either by the dealer or the particular player using holder and viewer 1. The longitudinal length of housing 2 and top wall 16 preferably is such whereby five usual size playing cards 22 can be placed face down therealong without overlap, since many card games require a hand of only five cards. However, a considerable number of other cards can be placed on top wall 16 in an overlapped relationship, such as when thirteen cards per hand are required as when playing bridge or other similar games.

The player using construction 1 need only look through window opening 4 to read cards 22 placed along top wall 16 since the card images are reflected by mirror 3 into the viewers eyes, as illustrated by dot-dash lines of sight 23, shown diagrammatically in FIG. 3. Sufficient light enters chamber 19 through opening 4 eliminating the need for any artificial light source. Also, additional light enters chamber 19 through transparent top wall 16.

Another important feature of holder and viewer 1 is the inability of any adjacent player being able to see the playing face of cards 22, either intentionally or accidentally, no matter how close they are to the user. The line of sight required for seeing the faces of cards 22 must be generally perpendicular into and through window opening 4 and toward mirror 3 since a line of sight entering opening 4 angularly from the side will not adequately see the playing card faces. Also, the remaining walls of holder construction 1 are opaque.

Accordingly, holder and viewer construction 1 provides a rectangular, somewhat prismatic-shaped housing having an elongated rectangular window opening which extends downwardly outwardly from front edge 17 of top wall 16 and forms an included obtuse angle of approximately 150° with top wall 16. Conceivably, holder construction 1 could be formed of a solid mass of transparent plastic material having a mirror or reflective surface embedded or formed therein at an angle as is mirror 3. The external surfaces of the block would be coated with an opaque material except for an upper horizontal card receiving surface and a downwardly inclined viewing window surface.

Figure 2:
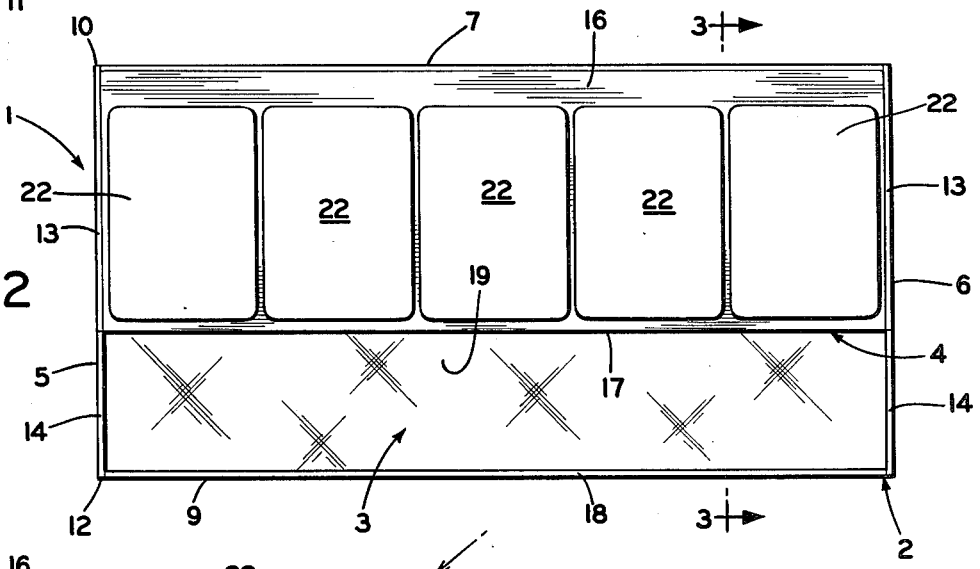
FIG. 2 is a top plan view of the card holder and viewer construction shown in FIG. 1, with five playing cards placed thereon.

A preferred size of holder and viewer 1 is a vertical height of five inches, a longitudinal length of twelve inches, and with top and bottom walls 16 and 8 having a width of four inches. This particular size enables five playing cards to be placed side-by-side, as shown in FIG. 2, without overlap when using most usual size playing cards.

Holder and viewer construction 1 provides an extremely simple, inexpensive construction which can be used easily by a person who is handicapped or unable to properly hold a plurality of playing cards while adding or subtracting thereto, which eliminates the need of any artificial light source for its operation, and which prevents accidental or intentional viewing of the user's cards by adjacent card players.

Accordingly, the construction is simplified, provides an effective, safe, inexpensive and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the card holder and viewer construction is constructed and used, the characteristics of the construction, and the advantageous, new and useful results obtained; the new and useful structures, devices, elements, arrangements, parts, and combinations, are set forth in the appended claims.

I claim:

1. Card holder and viewer construction including:

a) housing means having end walls, top and bottom walls, and front and rear walls forming a viewing chamber therebetween, with the end walls and front and rear walls being opaque, with at least a portion of the top wall being transparent and forming a card-receiving surface, and with said top wall lying in a generally horizontal plane with the front wall being inclined outwardly away from said top wall;

b) opening means formed adjacent the front and top walls; and c) mirror means mounted within the viewing chamber and positioned at a predetermined angle, whereby the image of a playing card placed upon the transparent top wall portion will be reflected by the mirror means through the opening means for observation by an individual looking through said opening means.

2. Card holder and viewer construction including:

a) housing means having end walls, top and bottom walls, and front and rear walls forming a viewing chamber therebetween, with the end walls and front and rear walls being opaque, and with at least a portion of the top wall being transparent and forming a card-receiving surface;

b) the end walls and the top and bottom walls being parallel to each other, respectively, said top and bottom walls being perpendicular to the end walls with the rear wall being perpendicular to the end, top and bottom walls, and said front wall extending upwardly outwardly from the bottom wall;

c) opening means formed adjacent the front and top walls; and d) mirror means mounted within the viewing chamber and positioned at a predetermined angle, whereby the image of a playing card placed upon the transparent top wall portion will be reflected by the mirror means through the opening means for observation by an individual looking through said opening means.

3. Card holder and viewer construction including:

a) housing means having end walls, top and bottom walls and front and rear walls forming a viewing chamber therebetween, with the end walls and front and rear walls being opaque, and with at least a portion of the top wall being transparent and forming a card receiving surface;

b) opening means formed adjacent the front and top walls, said opening means being an elongated, rectangularly-shaped opening defined by a front edge of the top wall, a top edge of the front wall, and portions of top edges of the end walls; and c) mirror means mounted within the viewing chamber and positioned at a predetermined angle, whereby the image of a playing card placed upon the transparent top wall portion will be reflected by the mirror means through the opening means for observation by an individual looking through said opening means.

4. The construction defined in claim 3 in which the viewing opening extends downwardly outwardly with respect to the top wall and forms an included obtuse angle of approximately 150° with respect to said top wall.

5. The construction defined in claim 3 in which the mirror means is inclined at an angle of approximately 30° with respect to the bottom wall and extends upwardly rearwardly from said bottom wall toward the rear wall.

6. Card holder and viewer construction including:

a) housing means having end walls, top and bottom walls, and front and rear walls forming a viewing chamber therebetween, with the end walls and front and rear walls being opaque, and with at least a portion of the top wall being transparent and forming a card receiving surface; said front wall extending upwardly outwardly from the bottom wall forming an included obtuse angle of approximately 120° with said bottom wall;

b) opening means formed adjacent the front and top walls; and c) mirror means mounted within the viewing chamber and positioned at a predetermined angle, whereby the image of a playing card placed upon the transparent top wall portion will be reflected by the mirror means through the opening means for observation by an individual looking through said opening means.

7. Card holder and viewer construction including:

a) housing means having end walls, top and bottom walls, and front and rear walls forming a viewing chamber therebetween, with the end walls and front and rear walls being opaque, with at least a portion of the top wall being transparent and forming a card receiving surface, and said end walls being similar to each other, each having a pentagonal configuration;

b) opening means formed adjacent the front and top walls; and c) mirror means mounted within the viewing chamber and positioned at a predetermined angle, whereby the image of a playing card placed upon the transparent top wall portion will be reflected by the mirror means through the opening means for observation by an individual looking through said opening means.

8. A card holder and viewer construction including a generally prismatic-shaped member having a transparent card receiving upper portion, viewing window means and a generally flat planar reflective mirror; the reflective mirror being mounted within the prismatic-shaped member beneath the card receiving upper portion and viewing window means; said reflective mirror being mounted at a predetermined angle with respect to the card receiving upper portion and window means, with the plane of the mirror being parallel with the plane of said window means in a transverse relationship, whereby the image of a playing card placed face down on said card receiving upper portion is reflected by the mirror means out of the window means for viewing by an individual looking into said window means; and the prismatic-shaped member having opaque outer surfaces surrounding the transparent card receiving upper portion and the viewing window means.

9. The construction defined in claim 8 in which the prismatic-shaped member is a housing having a hollow interior; and in which the mirror is mounted within the hollow interior vertically beneath the card receiving upper portion with the plane of the mirror being parallel with the plane of the card receiving surface in a longitudinal relationship.

10. A card holder and viewer construction including a generally prismatic-shaped member having a transparent card receiving upper portion, viewing window means and a generally flat planar reflective mirror means, said window means being angled downwardly outwardly with respect to said card receiving upper portion; the reflective mirror means being located within the prismatic-shaped member beneath the card receiving upper portion and viewing window means and at a predetermined angle with respect to the card receiving upper portion and window means whereby the image of a playing card placed face down on said card receiving upper portion is reflected by the mirror means out of the window means for viewing by an individual looking into said window means; and the prismatic-shaped member having generally opaque outer surfaces surrounding the transparent card receiving upper portion and the viewing window means.

* * * * *